US008429837B1

(12) United States Patent
Galustian et al.

(10) Patent No.: US 8,429,837 B1
(45) Date of Patent: Apr. 30, 2013

(54) BOOT ACCESSORY FOR LIMITING FOOT MOVEMENT IN STIRRUPS

(76) Inventors: Romeo Galustian, Sylmar, CA (US); Shiva Galustian, Sylmar, CA (US)

( * ) Notice: Subject to any disclaimer, the term of this patent is extended or adjusted under 35 U.S.C. 154(b) by 787 days.

(21) Appl. No.: 12/604,294

(22) Filed: Oct. 22, 2009

(51) Int. Cl.
*A43B 5/18* (2006.01)
*A43C 17/00* (2006.01)

(52) U.S. Cl.
USPC ..... 36/136; 36/131; D30/142; 54/47

(58) Field of Classification Search ..... 36/131, 36/132, 136, 114; 54/47, 48, 49, 49.5; D30/142; 24/336, 545, 555, 560
See application file for complete search history.

(56) References Cited

U.S. PATENT DOCUMENTS

| | | | | | |
|---|---|---|---|---|---|
| 35,448 | A | * | 6/1862 | Hudson | 54/83.2 |
| 261,733 | A | | 7/1882 | Larcom | |
| 267,728 | A | | 11/1882 | Shellenberger | |
| 295,423 | A | | 3/1884 | Philbrook | |
| 523,557 | A | * | 7/1894 | Tower | 24/72.1 |
| 594,926 | A | | 12/1897 | Anderson | |
| 741,408 | A | * | 10/1903 | McGill | 24/561 |
| 745,607 | A | | 12/1903 | Heaton | |
| 1,062,327 | A | | 5/1913 | Erbe | |
| 1,098,662 | A | | 6/1914 | Chappell | |
| 1,359,981 | A | * | 11/1920 | Fry | 24/570 |
| 1,885,995 | A | * | 11/1932 | Dowick | 132/276 |
| D108,285 | S | | 2/1938 | Hart | |
| 2,384,255 | A | * | 9/1945 | Moore, Sr. | 24/72.1 |
| 4,026,047 | A | * | 5/1977 | Ahmer | 36/136 |
| 4,474,383 | A | * | 10/1984 | Kikis | 281/45 |
| 4,507,881 | A | * | 4/1985 | Fossa | 36/132 |
| D394,525 | S | | 5/1998 | Simmons | |
| 6,513,309 | B1 | | 2/2003 | Morgante | |
| 2010/0050477 | A1 | * | 3/2010 | Zeek | 36/132 |

* cited by examiner

*Primary Examiner* — Jila M Mohandesi

(57) ABSTRACT

A boot accessory for limiting how far a user can push his/her boot into a stirrup comprises an arch for hugging a front edge of the boot; a first hook disposed on the first end of the arch and a second hook disposed on the second end of the arch. The first hook curves outwardly from the first end of the arch and further a first end of the first hook curves back toward the front edge of the boot. The second hook curves outwardly from the second end of the arch and further a first end of the second hook curves back toward the front edge of the boot. A gap exists between the first end of the first hook and the arch and between the first end of the second hook and the arch, wherein the gaps are for engaging sides of the stirrup.

11 Claims, 4 Drawing Sheets

BOOT ACCESSORY FOR LIMITING FOOT MOVEMENT IN STIRRUPS

FIELD OF THE INVENTION

The present invention is directed to an accessory for boots that can limit how far forward a rider pushes his/her feet into stirrups. The accessory comprises opposing hooks that engage the sides of the stirrup, which blocks excessive forward movement of the rider's foot.

BACKGROUND OF THE INVENTION

Riders, especially new riders, may have a tendency to slide their feet too far forward into stirrups. This can be dangerous if the rider falls from the horse, for example. The present invention features a boot accessory for helping to limit how far into stirrups a user can slide his/her feet.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
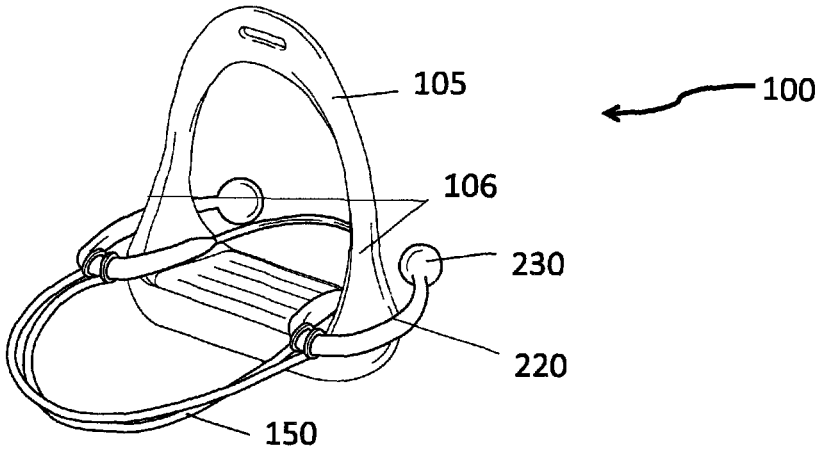
FIG. 1 is a perspective view of the boot accessory of the present invention, wherein the boot accessory is attached to a stirrup.
Figure 2:
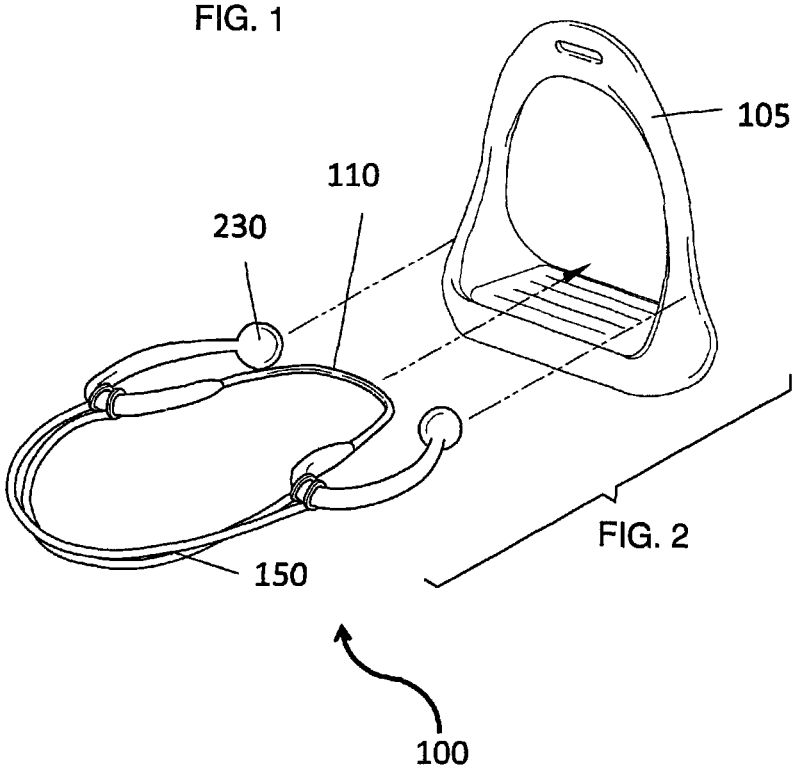
FIG. 2 is a perspective view of the boot accessory of FIG. 1, wherein the boot accessory is not attached to a stirrup.
Figure 3:
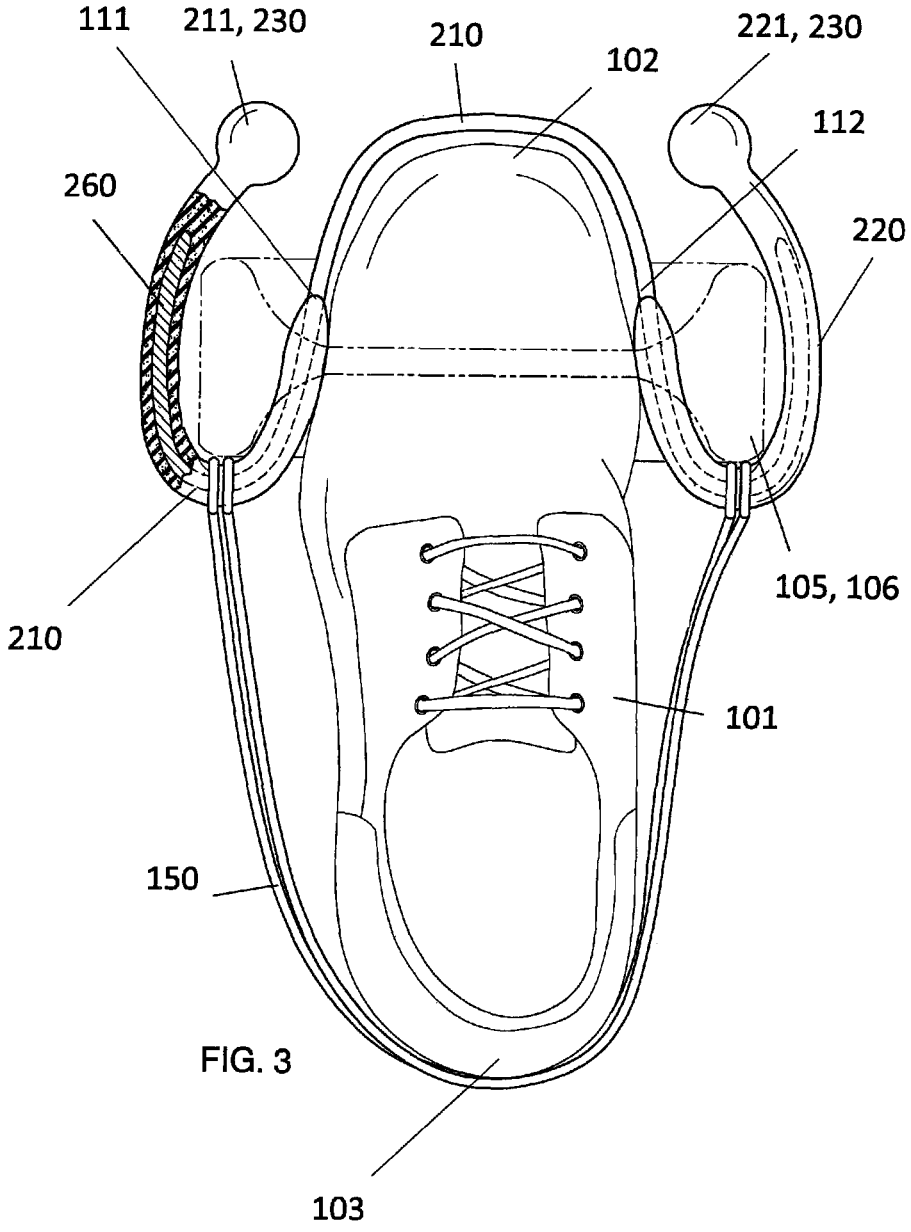
FIG. 3 is a top view of the boot accessory of FIG. 1.

Referring now to FIGS. 1-6, the present invention features a boot accessory 100 for limiting how far forward a rider can push his/her feet into stirrups 105. Without wishing to limit the present invention to any theory or mechanism, it is believed that the boot accessory 100 of the present invention is advantageous because the boot accessory 100 helps ensure that a rider's feet do not become stuck in stirrups if he/she falls from the horse.

The boot accessory 100 of the present invention comprises a boot component that is attachable to the boot 101. In some embodiments, the boot component is a center arch 110 for hugging the front edge 102 of a boot 101. The center arch 110 has a first end 111 and a second end 112, which generally extend toward the sides of the boot 101. Disposed on the first end 111 of the center arch 110 is a first hook 210 and disposed on the second end 112 of the center arch 110 is a second hook 220. The first hook 210 and second hook 220 curve outwardly from the first end 111 of the center arch 110 and the second end 112 of the center arch 110, respectively. The first hook 210 (e.g., first end of first hook) and second hook 220 (e.g., first end of second hook) both further curve back toward the front edge 102 of the boot 101. Generally the center arch 110, first hook 210, and second hook 210 lie in the same or similar planes.

A gap exists between the first end 211 of the first hook 210 and the center arch 110 as well as between the first end 221 of the second hook 220 and the center arch 110. The gaps allow the first hook 210 and second hook 220 to engage sides 106 of the stirrup 105. When the boot accessory 100 is attached to a boot 101 and the sides 106 of the stirrup 105 are engaged in the first hook 210 and second hook 220, the boot is blocked from being pushed too far forward into the stirrup 105 (by the first hook 210 and second hook 220).

The boot accessory 100 can be secured to the boot 101 via a securing means. For example, the securing means may include one or more straps 150 that extend from the first hook 210 around the back end 103 of the boot 101 to the second hook 220. The straps 150 can be tightened and loosened, allowing for a secure attachment to the boot 101 or easy removal from the boot 101.

In some embodiments, a ball 230 is disposed on the first end 211 of the first hook 210 and/or on the first end 221 of the second hook 220. In some embodiments, the ball 230 is constructed from a material comprising rubber.

The boot accessory 100 of the present invention may be constructed from a variety of materials. For example, in some embodiments, the boot accessory 100 is constructed from a material comprising a metal (e.g., flexible steel), a rubber, a plastic, a wood, the like, or a combination thereof. In some embodiments, the boot accessory 100 or a portion thereof is coated with rubber. In some embodiments, a flexible spring 260 is disposed inside the first hook 210 and/or the second hook 220.

Figure 4:
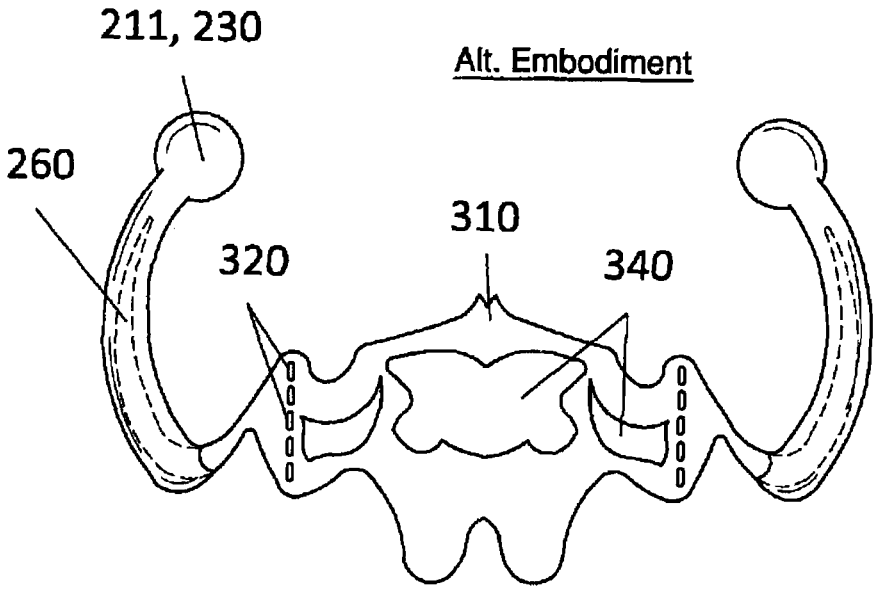
FIG. 4 is a top view of an alternative embodiment of the boot accessory of the present invention.

The present invention is not limited to the aforementioned configurations. For example, as shown in FIG. 4, in some embodiments, the boot component is a base plate 310 that can be attached to the boot 101 (e.g., the bottom surface or sole of the boot 101). The base plate 310 may allow for permanent attachment to the boot 101. In some embodiments, one or more attachment holes 320 are disposed in the base plate 310. The attachment holes 320 may allow the base plate 310 to be sewed onto the boot 101 (or the base plate 310 may be attached via an alternative means such as bolts, screws, etc.). In some embodiments, the boot accessory 100 is attached to a boot 101 during the manufacturing process. One or more secondary holes 340 may be disposed in the base plate 310. Attached to the first side edge of the base plate 310 is the first hook 210 and attached to the second side edge of the base plate 310 the second hook 220.

Figure 5:
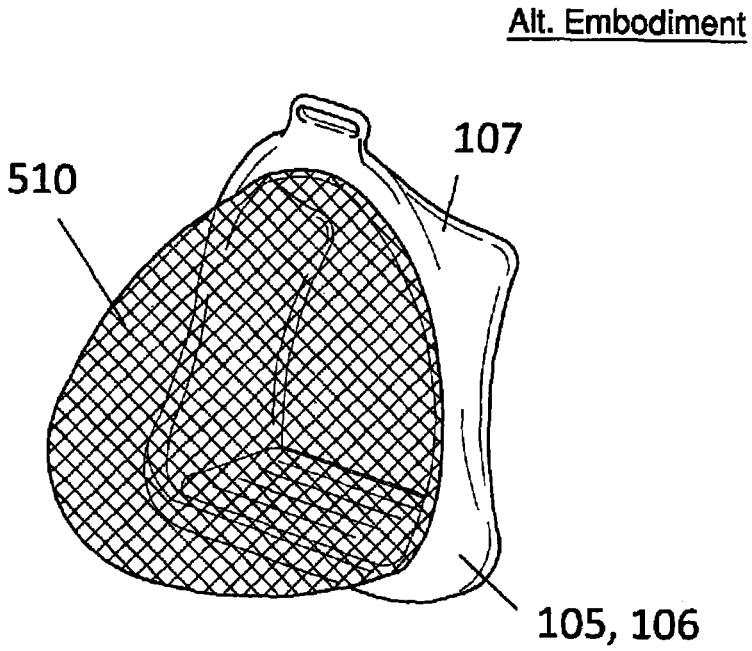
FIG. 5 is a perspective view of an alternative embodiment of the boot accessory of the present invention.
Figure 6:
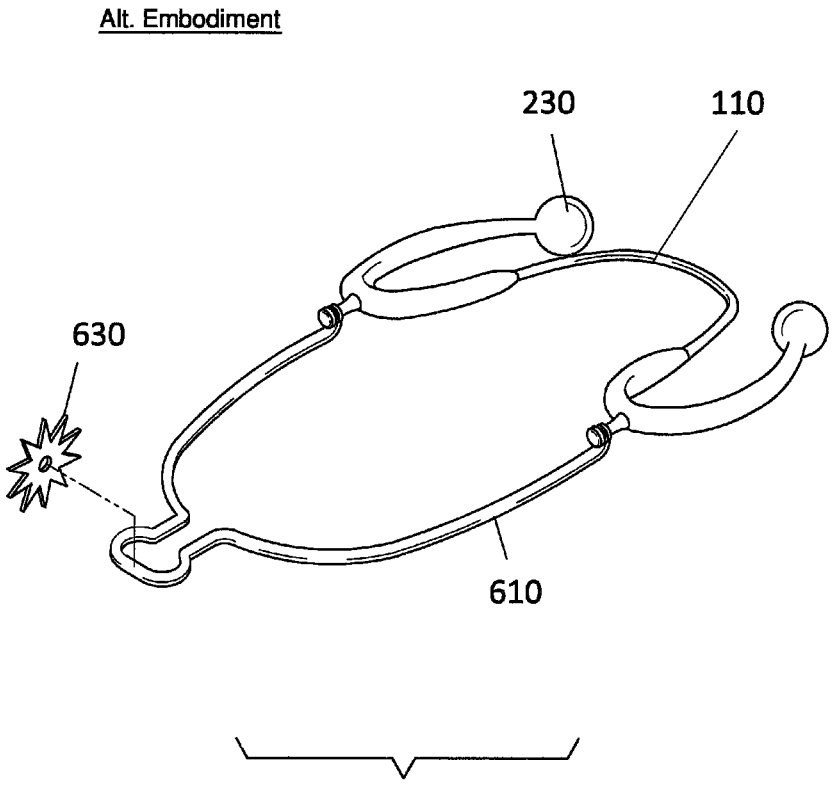
FIG. 6 is a perspective view of an alternative embodiment of the boot accessory of the present invention.

As shown in FIG. 5, in some embodiments, a holding net 510 is attached to the sides 106 (and top portion 107) of the stirrup 105, which limits how far forward a user can move his/her boot 101 in the stirrup 105.

In some embodiments, the securing means (for helping to secure the boot accessory 100 to a boot 101 may include a spur 610. The spur 610 may extend from the first hook 210 around the back end 103 of the boot 101 to the second hook 220. The spur 610 may resemble standard spurs 610, for example the spur 610 may comprise a rowel 630.

The following the disclosures of the following U.S. Patents are incorporated in their entirety by reference herein: U.S. Pat. No. 6,513,309; U.S. Pat. No. 1,062,327; U.S. Pat. No. 295,423; U.S. Pat. No. 261,733; U.S. Pat. No. 1,098,662; U.S. Pat. No. 745,607; U.S. Pat. No. 594,926; U.S. Pat. No. 267, 728.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A boot accessory system for limiting how far forward a user can push his/her boot into a stirrup, said boot accessory system comprising:

(i) a stirrup having two sides;

(ii) a boot accessory, wherein the boot accessory comprising:

(a) a center arch for hugging a front edge of the boot, the center arch has a first end and a second end;

(b) a first hook disposed on the first end of the center arch and a second hook disposed on the second end of the center arch; wherein the first hook curves outwardly from the first end of the center arch and further a first end of the first hook curves back toward the front edge of the boot, wherein the second hook curves outwardly from the second end of the center arch and further a first end of the second hook curves back toward the front edge of the boot; wherein the center arch, first hook, and second hook each lie in a same or a similar plane;

wherein an open gap exists between both the first end of the first hook and the center arch and between the first end of the second hook and the center arch, wherein the gaps are for embracing and engaging sides of the stirrup to stop the boot from moving forward into the stirrup.

2. The boot accessory of claim 1 further comprising a ball disposed on the first end of the first hook and on the first end of the second hook.

3. The boot accessory of claim 2, wherein the ball is constructed from a material comprising rubber.

4. The boot accessory of claim 1, wherein the boot accessory or a portion thereof is coated with rubber.

5. The boot accessory of claim 1, wherein a flexible spring is disposed inside the first hook and the second hook.

6. The boot accessory of claim 1, wherein the boot accessory further comprises a securing means to secure the boot accessory to the boot.

7. The boot accessory of claim 6, wherein the securing means includes one or more straps that extend from the first hook around the back end of the boot to the second hook.

8. The boot accessory of claim 7, wherein the straps can be tightened and loosened.

9. The boot accessory of claim 6, wherein the securing includes a spur.

10. The boot accessory of claim 9, wherein the spur comprises a rowel.

11. A boot accessory system for limiting how far forward a user can push his/her boot into a stirrup, said boot accessory system consisting of:

(i) a stirrup having two sides;

(ii) boot accessory, wherein the boot accessory comprising:

(a) a center arch for hugging a front edge of the boot, the center arch has a first end and a second end;

(b) a first hook disposed on the first end of the center arch and a second hook disposed on the second end of the center arch; wherein the first hook curves outwardly from the first end of the center arch and further a first end of the first hook curves back toward the front edge of the boot, wherein the second hook curves outwardly from the second end of the center arch and further a first end of the second hook curves back toward the front edge of the boot; wherein the center arch, first hook, and second hook each lie in a same or a similar plane;

wherein an open gap exists between both the first end of the first hook and the center arch and between the first end of the second hook and the center arch, wherein the gaps are for embracing and engaging sides of the stirrup to stop the boot from moving forward into the stirrup.

* * * * *